United States Patent [19]

Ootani et al.

[11] Patent Number: 4,486,338

[45] Date of Patent: Dec. 4, 1984

[54] LIQUID DETERGENT COMPOSITION CONTAINING SUCCINIC ACID DERIVATIVES

[75] Inventors: Naoteru Ootani, Funabashi; Takashi Ishii, Miyashiro; Hiroshi Ikeda, Sakura, all of Japan

[73] Assignee: Kao Corporation, Tokyo, Japan

[21] Appl. No.: 489,352

[22] Filed: Apr. 28, 1983

[30] Foreign Application Priority Data

May 11, 1982 [JP] Japan ..... 57-77577

[51] Int. Cl.[3] ..... C11D 1/04; C11D 1/22

[52] U.S. Cl. ..... 252/545; 252/174.19; 252/546; 252/547; 252/548; 252/551; 252/554; 252/555; 252/558; 252/DIG. 14

[58] Field of Search ..... 252/174.19, 546, 545, 252/547, 548, 551, 554, 555, 558, 89.1

[56] References Cited

U.S. PATENT DOCUMENTS

| | | | |
|---|---|---|---|
| 3,579,453 | 5/1971 | Dupre et al. | 252/174.19 |
| 3,898,187 | 8/1975 | Miller | 252/553 |
| 4,070,309 | 1/1978 | Jacobsen | 252/547 |
| 4,277,378 | 7/1981 | Tsujii et al. | 252/546 |
| 4,412,933 | 11/1983 | Klahr et al. | 252/174.19 |

FOREIGN PATENT DOCUMENTS

| | | |
|---|---|---|
| 38506 | 3/1977 | Japan . |
| 122898 | 9/1981 | Japan . |
| 38897 | 3/1982 | Japan . |
| 993044 | 5/1965 | United Kingdom . |

*Primary Examiner*—Prince E. Willis

*Attorney, Agent, or Firm*—Oblon, Fisher, Spivak, McClelland & Maier

[57] ABSTRACT

0.2–5% by weight of a succinic acid derivative represented by the formula:

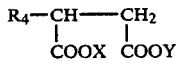

is included in the compounding system of a liquid detergent composition containing an anionic surfactant and tertiary amine oxide in combination, but not containing an alkaline builder.

Incorporation of such compound improves foamability, detergency and stability at low temperatures of a detergent composition.

A liquid detergent composition according to the invention comprises the following ingredients (A), (B) and (C).

(A): 10—40% by weight of anionic surface active agent.

(B): 0.2—5% by weight of a tertiary amine oxide.

(C): 0.2—5% by weight of a specific type of a succinic acid derivative.

8 Claims, No Drawings

LIQUID DETERGENT COMPOSITION CONTAINING SUCCINIC ACID DERIVATIVES

BACKGROUND OF THE INVENTION (i) Field of the Invention

The present invention relates to a liquid detergent composition having excellent foamability, detergency, stability at low temperatures and a low viscosity.

(ii) Description of the Prior Art

A liquid detergent such as an detergent for tablewares desireably satisfy the property requirements of superior detergency, foamability, and low irritativeness to the skin. In order to fulfill these requirements, an anionic surface active agent and a non-ionic surface active agent have been used as the chief ingredients to prepare a liquid detergent. Among the non-ionic surface active agents, a tertiary amine oxide has been known as an agent which produces an excellent effect (see Japanese Patent Specification Nos. 14979/1964 and 3264/1963).

However, a combined use of tertiary amine oxide and anionic surface active agent in preparing a liquid detergent generally gives disadvantages of reduced stability at low temperatures and raised viscosity. In order to prevent such disadvantages, ethanol or paratoluenesulfonate has been additionally incorporated. However, an incorporation with a small quantity thereof does not reveal any effect, whereas an incorporation with a large quantity thereof incurs inferior foaming property and inflammable danger.

A certain kind of succinic acid derivative has been used as one of the ingredients of liquid detergents. For example, Japanese Patent Application Laid-Open No. 142603/1975 describes a combined use of a succinic acid derivative represented by the formula:

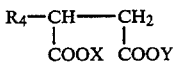

wherein $R_4$ is a hydrocarbon group having 4–14 carbon atoms, and a lower alcohol, both as the solubilizing agents of a heavy duty detergent. Japanese Patent Publication No. 35330/1973 discribes an addition of a water soluble salt of a succinic acid derivative represented by the formula:

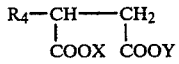

wherein $R_4$ is an alkyl group or alkenyl group containing 10–20 carbon atoms, as a builder substituted for tripolyphosphate. Further, Japanese Patent Application No. 142099/1980 describes a use of a succinic acid derivative represented by the formula:

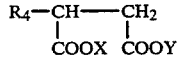

wherein $R_4$ is a hydrocarbon group having 8–18 carbon atoms as the main active ingredient of a detergent. However, the conventional use of the succinic acid derivative as an ingredient of a detergent is as an adjuvant in co-existence of an alkaline builder, or is as an active ingredient of the detergent.

SUMMARY OF THE INVENTION

The inventors have found that a liquid detergent composition having superior foamability, detergency, stability at low temperatures and adequate viscosity can be obtained by additionally compounding a specific type of succinic acid derivative to a liquid detergent containing an anionic surface agent and tertiary amine oxide in combination.

It must be noted that there has existed no technical concept of adding a small quantity of a specific type of succinic acid derivative to a compounding system wherein an alkaline builder does not attend, especially to a system of a liquid detergent containing anionic surface active agent and a tertiary amine oxide.

Accordingly, an object of the present invention is to provide a liquid detergent composition comprising the following three ingredients (A), (B) and (C):

(A) 10–40% by weight of at least one kind of anionic surface active agent selected from the group consisting of a polyoxyethylenealkylethersulfate, alkylbenzenesulfonate, α-olefinsulfonate, alkanesulfonate and ethercarboxylate.

(B) 0.2–5% by weight of a tertiary amine oxide represented by the following formula (I),

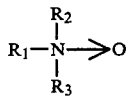

(I)

wherein $R_1$ represents an alkyl group or alkenyl group having 10–18 carbon atoms, $R_2$ and $R_3$ independently represent an alkyl group having 1–2 carbon atoms.

(C) 0.2–5% by weight of a succinic acid derivative represented by the following formula (II),

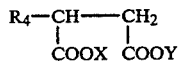

(II)

wherein $R_4$ represents an alkyl group or alkenyl group having 4–8 carbon atoms, X and Y independently represent a hydrogen atom, alkali metal, ammonium or a water soluble alkanolamine.

DETAILED DESCRIPTION OF THE INVENTION AND PREFERRED EMBODIMENT

The anionic surface active agent to be used in the present invention is a polyoxyethylenealkylethersulfate, alkylbenzenesulfonate, α-olefinsulfonate, alkanesulfonate or ethercarboxylate. Of these compounds, a polyoxyethylenealkylethersulfonate is preferable on the grounds of being mild to the skin, and especially, the compounds which contain 8–18 carbon atoms and have the average additional mole number of the ethyleneoxide of from 1 to 5, are preferable. As for an alkylbenzenesulfonate, it is used on the grounds of detergency and its low price. As the preferable example of an polyoxyethylenealkylethersulfate, the compound represented by the following formula (III) may be cited.

$$R_5—O\text{-}(CH_2CH_2O)_n SO_3M \quad \text{(III)}$$

wherein $R_5$ represents an alkyl group or alkenyl group having 8–18 carbon atoms, M represents an alkali metal, ammonium or an alkanolamine, n represents an integer of 1 to 5. And as the example of an alkylbenzenesulfonate, the compound represented by the following formula (IV) may be cited.

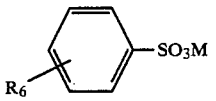

(IV)

wherein $R_6$ represents an alkyl group of 10–16 carbon atoms, M has the same meaning as mentioned above. Furthermore, as an ethercarboxylate, the compound represented by the following formula (V) may be cited.

$$R_7O\text{-}(CH_2CH_2O)_nCH_2COOM' \quad (V)$$

wherein $R_7$ represents an alkyl group or alkenyl group having 8–16 carbon atoms, M' represents a sodium, potassium or an alkanolamine, n represents an integer of 1 to 5.

The tertiary amine oxide to be used in the present invention is the compound represented by the following formula (I),

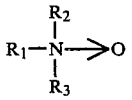

(I)

wherein $R_1$, $R_2$ and $R_3$ have the same meanings as mentioned above.

In terms of detergency, much longer chain alkyl group of a tertiary amine oxide preferable, and as far as the foamability is concerned, the compound having 12 carbon atoms is the most preferable.

The tertiary amine oxide to be compounded to the liquid detergent composition of the invention is suitably 0.2–5% by weight (hereinafter referred to as simply %).

The succinic acid derivative to be used in the present invention is represented by the following general formula (II),

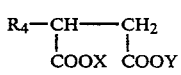

(II)

wherein $R_4$, X and Y have the same meanings as above, and such compound can be prepared by converting a succinic anhydride substituted with an alkyl or alkenyl which can be obtained by reacting olefin of 4–8 carbon atoms with maleic anhydride or by hydrogenating the resulting compound of said reaction to its water soluble salt. As the substituted salt (or partially substituted salt) which is to be converted into a water soluble salt, an alkali metal salt, mono-, di- tri-ethanolamine salt, ammonium salt may be cited. Suitable content of the succinic acid derivative is within a range of 0.2–5%.

In addition to the above essential ingredients, a nonionic active agent such as polyoxyalkylenealkyl or polyoxyalkylenealkylphenyl ether, fatty acid alkylolamide; an amphoteric active agent such as alkylbetaine, alkylsulfobetaine etc.; solubilizing agent, a hydrotropic agent, an opacifier, a chelating agent, a preservative, a colorant, a perfume, an ultraviolet ray absorbent, an oxidation-stabilizing agent, or a thickener etc. may be compounded to the liquid detergent composition of the present invention.

The liquid detergent composition of the present invention can be used as a detergent for washing tablewares, cooking utensils, foods, dwellings, clothes (of light quality) and as a shampoo etc., but should not be limited only to them.

The present invention is illustrated by the following examples:

EXAMPLES

EXAMPLE 1

Liquid detergent compositions containing the following ingredients were prepared, and the turbidity, temperature and the viscosity were measured.

The results are shown in Table 2.

COMPOSITION

| | |
|---|---|
| Sodium polyoxyethylenealkylsulfate (EOP = 2, C = 12 (Straight chain rate 85%)) | 20% |
| Dimethyldodecylamineoxide | 10% |
| Solubilizing agent (Table 1) | |
| Water | Balance |

TABLE 1

| Solubilizing agent ingredients | Solubilizing agent Nos. Comparison Products 1 | 2 | 3 | 4 | Invention Products 5 | 6 |
|---|---|---|---|---|---|---|
| Ethanol | 5% | 10% | 0% | 0% | 0% | 0% |
| Sodium p-toluenesulfonate | 0 | 0 | 1 | 2 | 0 | 0 |
| Sodium octenylsuccinate | 0 | 0 | 0 | 0 | 0.2 | 0.4 |

RESULTS

TABLE 2

| Items | Solubilizing agent Comparison Products 1 | 2 | 3 | 4 | Invention Products 5 | 6 | Control** |
|---|---|---|---|---|---|---|---|
| Viscosity* (cp) | 150 | 60 | 250 | 50 | 120 | 50 | 1300 |
| Turbidity | 2.2 | 0.3 | 2.0 | 1.7 | −2.0 | −4.5 | 3.0 |
| Temperature (°C.) | | | | | | | |

*Viscosity: Viscosity of the product diluted twice of the liquid detergent composition at 25° C.
Unit cp (centi poise): B type viscosity meter was used.
**Control: Liquid detergent composition not containing solubilizing agent.

As it can be seen from the foregoing results, the addition of octenylsuccinate in a small quantity is effective for reduction of viscosity and stabilization at low temperatures of liquid detergent.

EXAMPLE 2

Liquid detergent compositions shown in Table 3 were prepared and the detergency, foamability and stability at low temperatures were tested.

TESTING METHOD

(a) Detergency

Sundan III (Red colorant) was added as indicator to beef tallow by 0.1%, and 5 g of this coloured beef tallow was painted on the porcelain plates (25 cm in diameter). These plates were washed with a sponge loaded with 10 g of a detergent and 20 g of water.

The detergency was represented by the number of the plates which were clearly washed up, above which number the beef tallow could no more be clearly removed by the same sponge.

(b) Foamability

To 0.5% detergent solution, butter on the market was added by 0.1% as a dirt ingredient, and the foamability of the detergent was tested. Testing method is as follows: 40 ml of the above detergent solution containing butter was placed in a glass cylinder having a diameter of 5 cm and rotary agitation was conducted for 10 minutes. The foam height was measured immediately after the agitation was stopped.

(c) Stability at low temperatures

The samples were preserved in a thermostatic chamber at −5° C. for 10 days and properties were evaluated.

| Evaluation | Observation |
|---|---|
| o | No change |
| Δ | Turbid somewhat |
| X | Separated or precipitated |

TABLE 4-continued

| Succinic acid derivatives | Results Composition Nos. 19 | 20 | 21 | 22 | 23 | 24 | 25 | 26 | 27 |
|---|---|---|---|---|---|---|---|---|---|
| succinate | | | | | | | | | |
| Sodium butenylsuccinate | | 2 | | | | | | | |
| Sodium octylsuccinate | | | 2 | | | | | | |
| Sodium octenylsuccinate | | | | 1 | | | | | |
| Sodium octenylsuccinate | | | | | 2 | | | | |
| Sodium octenylsuccinate | | | | | | 4 | | | |
| Sodium octenylsuccinate | | | | | | | 10 | | |
| Sodium dodecenylsuccinate | | | | | | | | 2 | |
| Dodecenylsuccinate-diethanolamine | | | | | | | | | 2 |
| Detergency (Numbers of plates) | 3 | 4 | 4 | 4 | 4 | 4 | 4 | 3 | 3 |
| Foamability (m/m) | 75 | 80 | 85 | 90 | 85 | 80 | 65 | 85 | 80 |
| Stability at low temps. | x | o | o | o | o | o | o | x | x |

Composition Nos. 20–24 are Invention Products.
Others are Comparison Products.

TABLE 3

| | Comparison Products 7 | 8 | 9 | 10 | 11 | 12 | 13 | 14 | 15 | Invention Products 16 | 17 | 18 |
|---|---|---|---|---|---|---|---|---|---|---|---|---|
| Sodium straight chain laurylbenzenesulfonate | 20 | 20 | 20 | 20 | | | | | | 20 | | |
| Sodium polyoxyethylene-alkylsulfate EO $\overline{P}$ = 2, $\overline{C}$ = 12 | | | | | 20 | 20 | 20 | 20 | | | 20 | |
| Sodium polyoxyethylene-alkyletheracetate EO $\overline{P}$ = 3, $\overline{C}$ = 12 | | | | | | | | | 20 | | | 20 |
| Lauryldimethylamineoxide | | 3 | 3 | 3 | | 3 | 3 | 3 | 3 | 3 | 3 | 3 |
| Coconut fatty acid diethanolamide | | | | 5 | | | | 5 | 5 | | | |
| Sodium p-toluenesulfonate | | | 5 | 5 | | | 5 | 5 | | | | |
| Ethanol | 10 | 10 | 5 | 5 | 10 | 10 | 5 | 5 | 5 | | | |
| Sodium hexenylsuccinate | | | | | | | | | | 2 | 2 | 2 |
| Water* | B | B | B | B | B | B | B | B | B | B | B | B |
| Detergency (Numbers of plates) | 3 | 2 | 3 | 4 | <1 | 3 | 3 | 4 | 3 | 5 | 4 | 3 |
| Foamability (m/m) | 80 | 65 | 75 | 100 | 50 | 85 | 85 | 90 | 65 | 110 | 85 | 80 |
| Stability at low temperatures | o | x | x | x | o | x | Δ | Δ | x | o | o | o |

*Symbol "B" means balance.

EXAMPLE 3

Liquid detergent compositions containing the following ingredients were prepared, and the detergency, foamability and stability at low temperatures were evaluated similarly to Example 2.

COMPOSITION

| | |
|---|---|
| Sodium polyoxyethylenealkylsulfate (EOP = 2, C = 12) | 20% |
| Lauryldimethylamine oxide | 3% |
| Succinic acid derivative (Table 4) | |
| Water | Balance |

TABLE 4

| Succinic acid derivatives | Results Composition Nos. 19 | 20 | 21 | 22 | 23 | 24 | 25 | 26 | 27 |
|---|---|---|---|---|---|---|---|---|---|
| Sodium propenyl- | 2 | | | | | | | | |

EXAMPLE 4

Washing tests of tablewares were carried out by 30 women on the invention product No. 17 and the comparison product No. 14 at their homes.

The results were as follows:

| | |
|---|---|
| Better feeling for foaming in composition No. 17 | 4 |
| Slightly better feeling for foaming in composition No. 17 | 8 |
| Cannot distinguish between product N0. 17 and product No. 14 | 11 |
| Slightly better feeling for foaming in composition No. 14 | 6 |
| Better feeling for foaming in composition No. 14 | 1 |

From the above results, it was confirmed that the invention product No. 17 has improved the touch of the foam of detergent.

What is claimed is:

1. A liquid detergent composition comprising the following ingredients (A), (B) and (C):

(A) 10–40% by weight of at least one kind of anionic surface active agent selected from the group consisting of polyoxyethylenealkylethersulfate, alkylbenzenesulfonate, α-olefinsulfonate, alkanesulfonate and ethercarboxylate.

(B) 0.2–10% by weight of a tertiary amine oxide represented by the following formula (I),

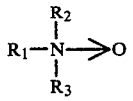

(I)

wherein $R_1$ represents an alkyl group or alkenyl group having 10–18 carbon atoms, $R_2$ and $R_3$ independently represent an alkyl group having 1–2 carbon atoms, (C) 0.2–5% by weight of a succinic acid derivative represented by the following formula (II),

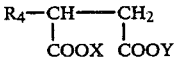

(II)

wherein $R_4$ represents an alkyl group or alkenyl group having 4–8 carbon atoms, X and Y independently represent a hydrogen atom, alkali metal, ammonium or a water-soluble alkanolamine.

2. A liquid detergent composition as claimed in claim 1, wherein the ingredient (A) is a polyoxyethylenealkylethersulfate represented by the following general formula (III), $$R_5—O—(CH_2CH_2O)_nSO_3M \quad \text{(III)}$$

wherein $R_5$ represents an alkyl group or alkenyl group having 8–18 carbon atoms, M represents an alkali metal, ammonium or an alkanolamine, n represents an integer of 1 to 5.

3. A liquid detergent composition as claimed in claim 1, wherein the ingredient (A) is an alkylbenzenesulfonate represented by the following general formula (IV),

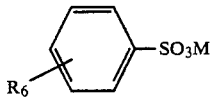

(IV)

wherein $R_6$ represents an alkyl group having 10–16 carbon atoms, M has the same meaning as mentioned above.

4. A liquid detergent composition as claimed in claim 1, wherein the ingredient (A) is an ethercarboxylate represented by the following formula (V), $$R_7O—(CH_2CH_2O)_nCH_2COOM' \quad \text{(V)}$$

wherein $R_7$ represents an alkyl group or alkenyl group having 8–16 carbon atoms, M' represents a sodium, potassium or an alkanolamine, n represents an integer of 1 to 5.

5. The detergent composition of claim 1 wherein $R_1$ in the tertiary amine oxide is a $C_{12}$ alkyl or alkenyl group.

6. The detergent composition of claim 1 further comprising:

a non-ionic active agent;
an amphoteric active agent;
a solubilizing agent;
a hydrotropic agent;
an opacifier;
a chelating agent;
a preservative;
a colorant;
a perfume;
an ultraviolet ray absorbent;
an oxidation-stabilizing agent; or
a thickener.

7. The detergent composition of claim 6, wherein the non-ionic active agent is polyoxyalkylenealkylphenylether, polyoxyalkylenealkylether or fatty acid alkylolamide.

8. The detergent composition of claim 6, wherein the amphoteric active agent is alkylbetaine or alkylsulfobetaine.

* * * * *